US007481727B2

(12) United States Patent
Chia

(10) Patent No.: US 7,481,727 B2
(45) Date of Patent: Jan. 27, 2009

(54) WATER-RELEASE TOY

(76) Inventor: Francis See Chong Chia, 17 Kadoorie Ave, Kowloon, Hong Kong, Hong Kong (CN)

( * ) Notice: Subject to any disclaimer, the term of this patent is extended or adjusted under 35 U.S.C. 154(b) by 172 days.

(21) Appl. No.: 11/731,889

(22) Filed: Apr. 2, 2007

(65) Prior Publication Data

US 2008/0242457 A1 Oct. 2, 2008

(51) Int. Cl.
*A63B 43/00* (2006.01)

(52) U.S. Cl. ..... 473/577; 473/594

(58) Field of Classification Search ..... 473/577, 473/594; 446/267, 473, 186; 273/457, 458; 102/513

See application file for complete search history.

(56) References Cited

U.S. PATENT DOCUMENTS 4,212,460 A * 7/1980 Kraft ..... 473/577
4,881,733 A 11/1989 Rehkemper et al.
4,890,838 A 1/1990 Rudell et al.
4,991,847 A 2/1991 Rudell et al.
5,018,449 A * 5/1991 Eidson, II ..... 102/513
5,240,450 A 8/1993 Graham
5,531,626 A 7/1996 Deal
5,538,456 A 7/1996 Liu et al.
6,146,292 A * 11/2000 Yamanaka ..... 473/594

* cited by examiner

*Primary Examiner*—Steven Wong
(74) *Attorney, Agent, or Firm*—Frank Marino

(57) ABSTRACT

A throwing and catching ball and several games using the same are disclosed. The ball has a perforated outer shell surrounding a hollow interior chamber containing a water-filled balloon. Activation of an actuator adjacent the outer shell, such as when catching the ball, causes a prick to extend into the chamber to burst the balloon and the liquid splashes from the chamber onto the catching victim. A removable fitting allows the balloon to be easily replaced after bursting. A filling system allows the balloon to be filled from outside of the ball after its insertion into the chamber.

15 Claims, 4 Drawing Sheets

WATER-RELEASE TOY

FIELD

A throwing and catching ball and game, and in particular, a perforated hollow ball containing a water-filled balloon and a balloon bursting mechanism that may be inadvertently triggered by catching participants to cause the balloon to burst.

BACKGROUND AND OBJECTS

Numerous throwing and catching toys exist which contain water-filled balloons that may burst to soak victim participants. One such toy in the marketplace is manufactured by Galoob Toys Inc and sold under the trademark "Splash Out". This toy is apparently the subject of U.S. Pat. Nos. 4,991,847 and 4,890,838 to Rudell et al.

The "Splash Out" is a hollow plastic ball which contains a replaceable water-filled balloon and a timer-activated balloon bursting mechanism. The bursting mechanism causes a prick to be extended into the balloon to burst the balloon and cause victim participants nearby to be splashed as the timer setting expires, which time is difficult for participants to predict. Participants play "catch" with the ball, knowing that the balloon will burst at some point in time, which is completely out of each participant's control. The object of the game is to avoid being a nearby participant at the moment that the balloon bursts.

Another such toy is the subject of U.S. Pat. No. 5,538,456 to Liu et al. This toy is a hollow plastic housing having an integral inwardly-projecting prick. The housing contains a replaceable balloon, filled with water to cause the balloon to partially fill the interior of the housing without abutting the prick. Presumably, the user must precisely estimate the amount of water to fill into the balloon to avoid having it expand so large that it will abut the prick as it is inserted into the housing, which would cause it to immediately burst. The toy is then either thrown at or to a victim participant such that the continuing momentum of the balloon as the toy hits or is caught by a victim participant causes the balloon to abut the prick, thereby bursting the balloon and causing it to splash its water over the victim participant. Participants have essentially no control to avoid having the balloon burst as the toy is being caught or as it hits them.

Among the objects of the present disclosure is a throwing and catching toy containing a burstable water-filled balloon which allows catching participants some degree of control over the bursting of the balloon according to the manner in which they catch it.

Among the advantages of the present disclosure is that participants may increase skill with practice and decrease risk with dexterity and agility to catch the toy without bursting the balloon, and need not rely solely on chance to avoid being soaked by the bursting balloon. Also among the advantages of the present disclosure are both a simple means for replacing spent balloons and a simple and reliable means for filling new balloons with water.

Further objects and advantages will be apparent upon a review of the following description and drawings, which are intended to exemplify, but not limit the invention.

SUMMARY

Disclosed herein is a perforated hollow ball having a water-filled balloon inside and a balloon bursting mechanism that causes a prick to burst the balloon when the mechanism activated, such as when a burst activator of the mechanism is inadvertently pressed during catching by a participant. Depending on the ability of catching participants to avoid pressing the activator of the bursting mechanism, with either skill or luck, bursting may be avoided. The catching participants therefore have control to avoid being victim participants and getting soaked by water from the bursting balloon.

Participants may increase skill with catching practice and decrease risk with dexterity and agility to catch the toy without pressing the burst activator, and need not rely solely on chance to avoid being soaked by the bursting balloon.

When the burst activator is accidentally pressed during catching, water from the bursting balloon spills through the perforations of the ball's housing to soak the catching participant, thereby making that participant a victim. The perforations are disposed in an evenly dispersed array about the ball and have various sizes and shapes, which feature is found to optimize the spray distribution from the toy during bursting, thereby maximizing the soaking of victim participants.

Replacement and refilling of spent balloons is made simple and reliable by novel and convenient means which do not require disassembly of the toy or any dedicated adapters or additional components. The new balloon is filled after insertion into the toy, and the toy is adapted to minimize the risk of overfilling and inadvertent bursting during filling.

A more complete understanding will be realized upon review of the following description and appended drawings which provides disclosure of only one of the almost infinite number of possible arrangements and permutations of the present invention, and which is in no way intended to limit the scope of the invention.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

Although the drawings and following description will proceed with reference being made to illustrative embodiments, many alternatives, modifications, and variations thereof will be apparent to those skilled in the art. Accordingly, it is intended that the claimed subject matter be viewed broadly.

DETAILED DESCRIPTION

Figure 1:
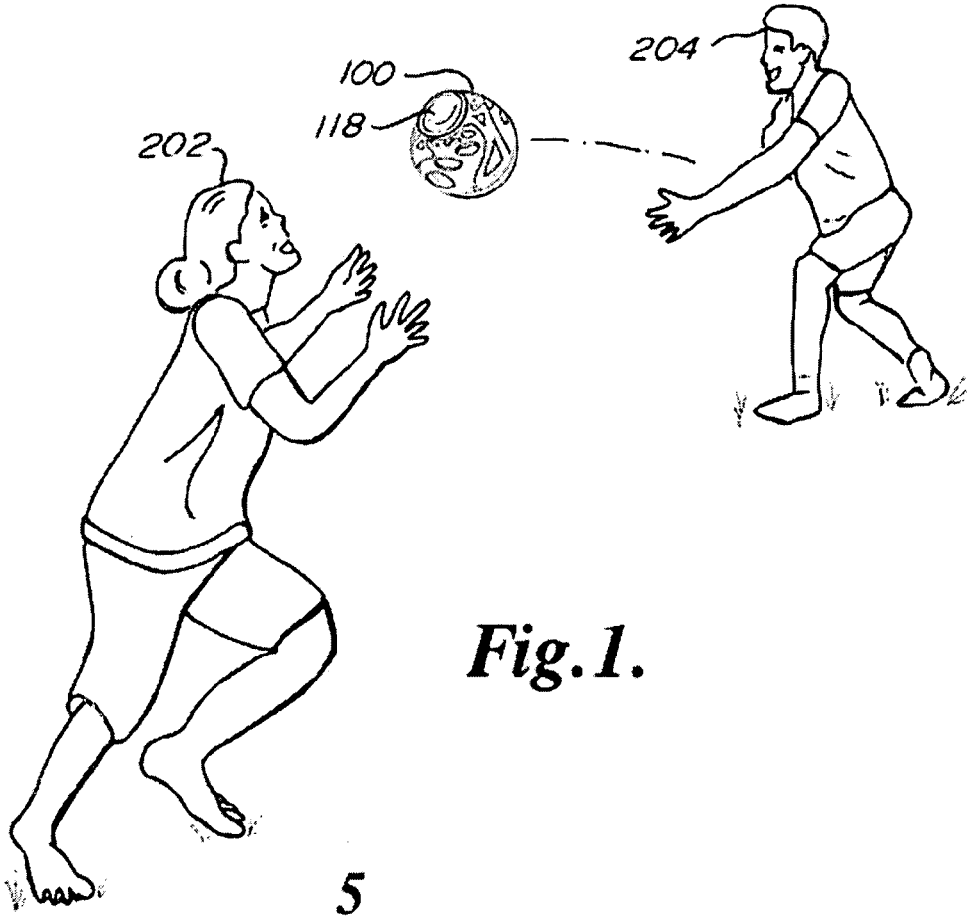
FIG. 1 is a view of two participants playing catch with the disclosed ball.
Figure 2:
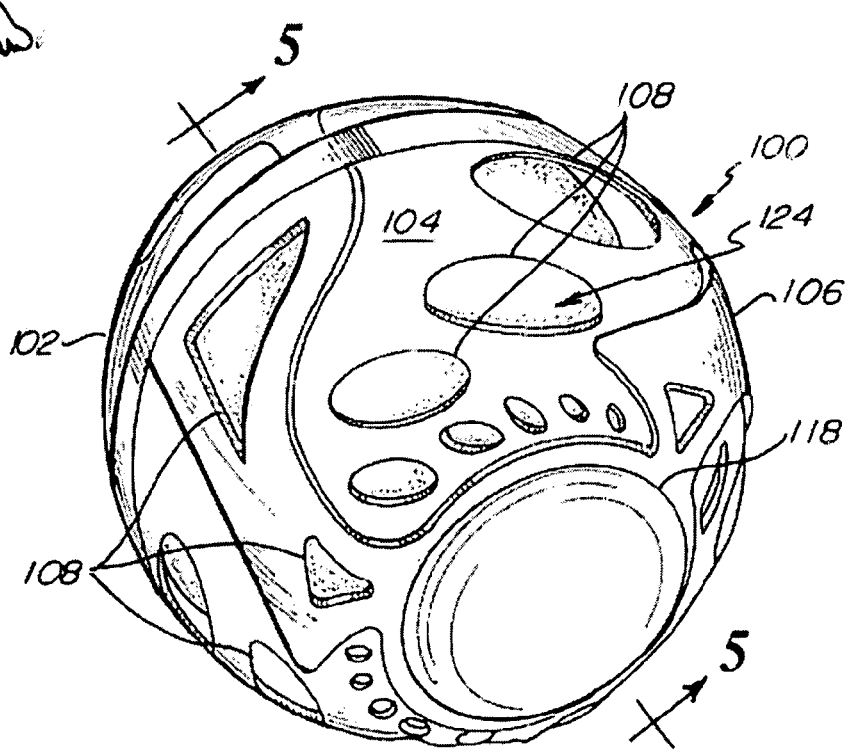
FIG. 2 is a perspective view of the ball of FIG. 1 showing its burst activator button.
Figure 3:
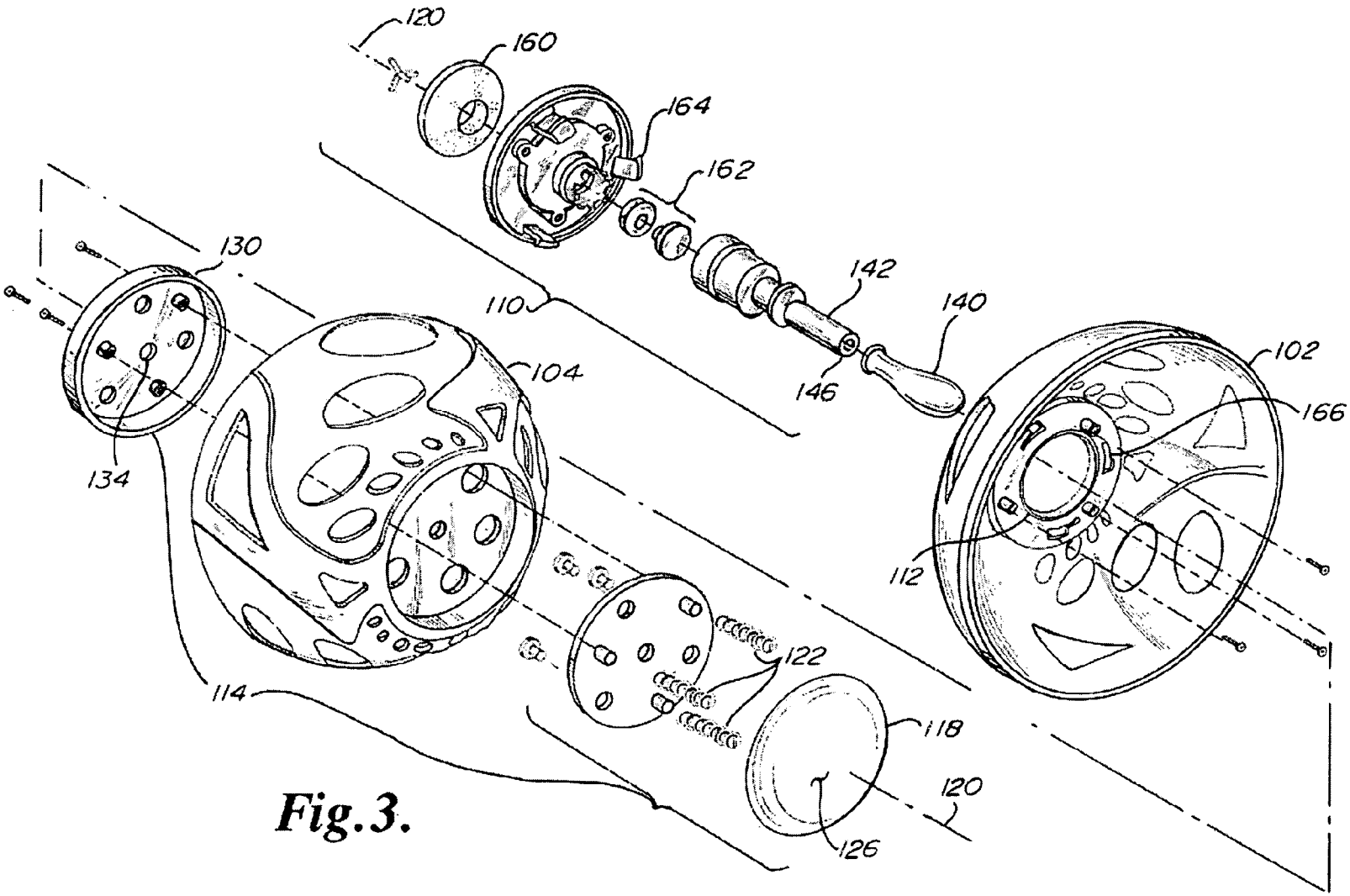
FIG. 3 is an exploded perspective view of the ball of FIG. 1.

A preferred embodiment of the water-release throwing and catching toy is shown as ball 100 in FIGS. 1 though 6. FIG. 1 depicts two players, throwing participant 204 and catching participant 202 playing a game of "catch" with ball 100. Ball 100 comprises a first semi-spherical housing half 102 and a second semi-spherical housing half 104. The housing halves are made of a thermoplastic material, such as ABS or polystyrene and are permanently joined together, such as by gluing or ultrasonic welding, to form hollow spherical housing 106. Each of the housing halves 102 and 104 are perforated with holes 108 of various sizes and shapes, distributed somewhat evenly.

First housing half 102 is adapted to removably receive a balloon support/fill fitting 110 through orifice 112 of the housing. Second housing half 104 includes a burst mechanism 114, including a prick 116 and actuator button 118 which are rigidly affixed together and translatable along a longitudinal axis 120 of the housing 106. Springs 122 bias prick 116 and actuator button 118 outwardly from the hollow interior chamber 124 of housing 106, so that the spherical outer surface 126 of actuator button 118 is normally co-spherical with housing 106 and so that the tip 128 of prick 116 is normally retracted into sub-housing 130 of burst mechanism 114, and is thereby not exposed within the interior chamber 124.

Spherical outer surface 126 of activator button 118 may be of a contrasting color to the surrounding portion of second housing half 104 to make it easier for participants to instantly differentiate and avoid the actuator button in embodiments of the ball that are intended for the less skillful. Alternatively, the button and surrounding portion of the housing may be of a similar color, making it more difficult to differentiate in embodiments of the ball that are intended for the more skillful.

Figure 6:
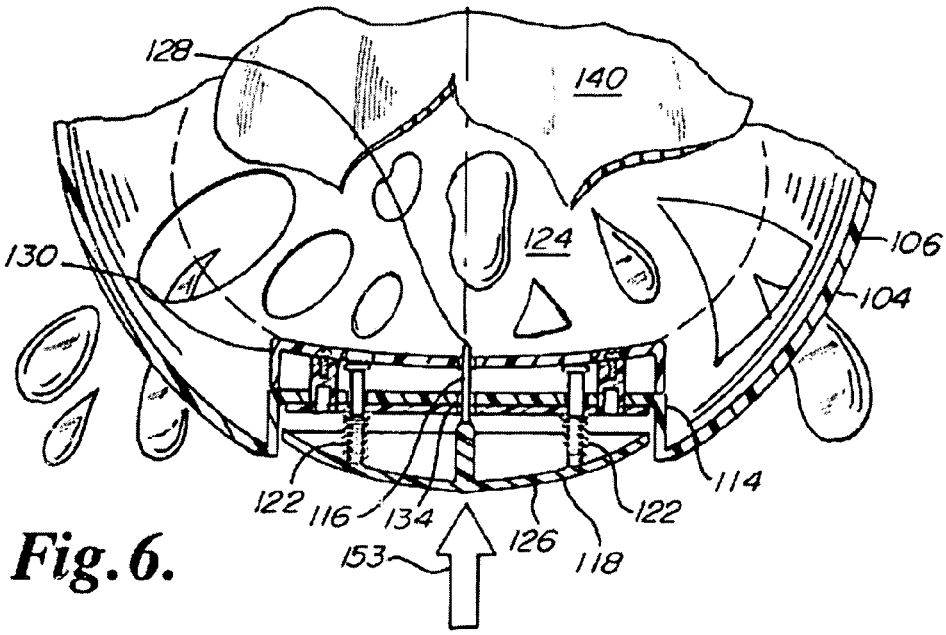
FIG. 6 is a partial cross-sectional view showing the bursting of the balloon.

Referring to FIG. 6, it can be seen that an inward force, represented by arrow 132, against activator button 118, causes the tip 128 of prick 116 to extend through hole 134 of sub-housing 130 and into hollow interior chamber 124. Although disclosed prick 116 is a needle, it may also be another sharp-edged element such as a blade, and hole 134 could then be a slot through which the blade could extend when actuator button 118 is forced inwardly.

Figure 4:
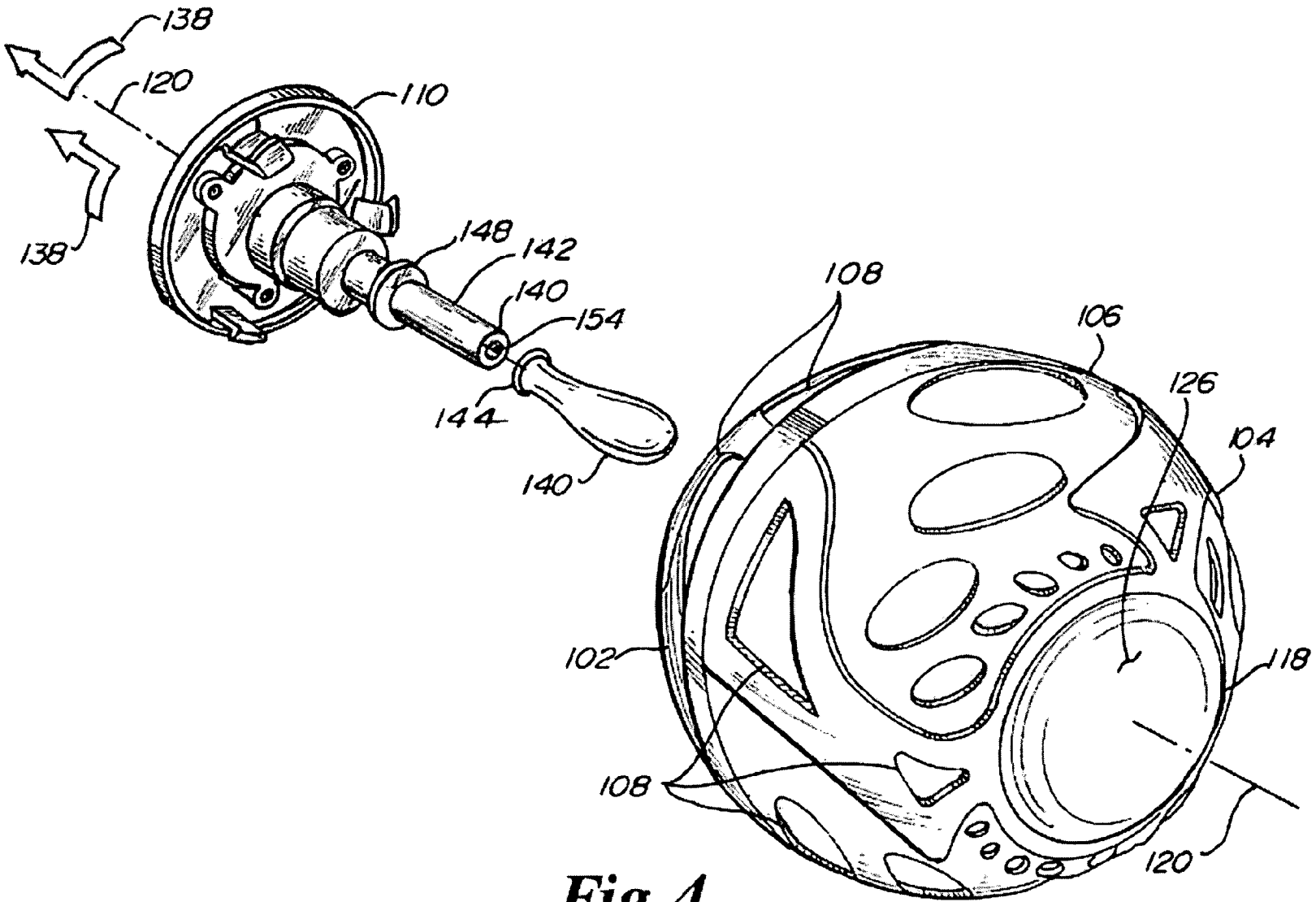
FIG. 4 is a perspective view of the ball of FIG. 1 showing the removal of the balloon support mechanism for replacement of the balloon.

Balloon support/fill fitting 110 is removed from housing 106 by the bayonet-type "twist and pull" action represented by arrows 138 of FIG. 4. Balloon 140 may then be attached to post 142 of assembly 110 by stretching the mouth 144 of the elastic balloon over the fitting's inner end 146 and over retention flange 148. Balloon support/fill fitting 110 comprises a fluid inlet 150 at the fitting's outer end 152 and a fluid outlet 154 at the fitting's inner end 146. Fluid inlet 150 and fluid outlet 154 communicate via conduit 158 which extends between outer end 152 and inner end 146.

Fluid inlet 150 comprises a resilient annular seal 160 to sealingly engage the face of a water supply fitting by pressing housing 106 there-against. Seal 160 may be made of rubber, foam rubber, or some similarly resilient material and may be glued to fitting 110. Fluid outlet 154, post 142, and retention flange 148 collectively form a nipple. Check valve 162 is disposed within conduit 158 and allows fluid, preferably water, to flow there-through only from inlet 150 to outlet 152, but prevents the backflow of water from the outlet to the inlet.

With balloon 140 properly stretch-fitted over post 142 and the balloon's interior in fluid communication with outlet 152, the deflated balloon and the inner end 146 of fitting 110 are inserted through orifice 112 and the fitting is affixed to housing 106 with a reversal of the "twist and pull" removal action. In a bayonet-type "push and twist" action, hooks 164 are longitudinally inserted through tangential key slots 166 and the fitting is rotated clockwise for several angular degrees to lock the fitting into the housing so that the spherical outer surface 168 of outer end 152 is co-spherical with housing 106. Balloon 140 now resides, in a deflated state, within hollow interior chamber 124.

Figure 5:
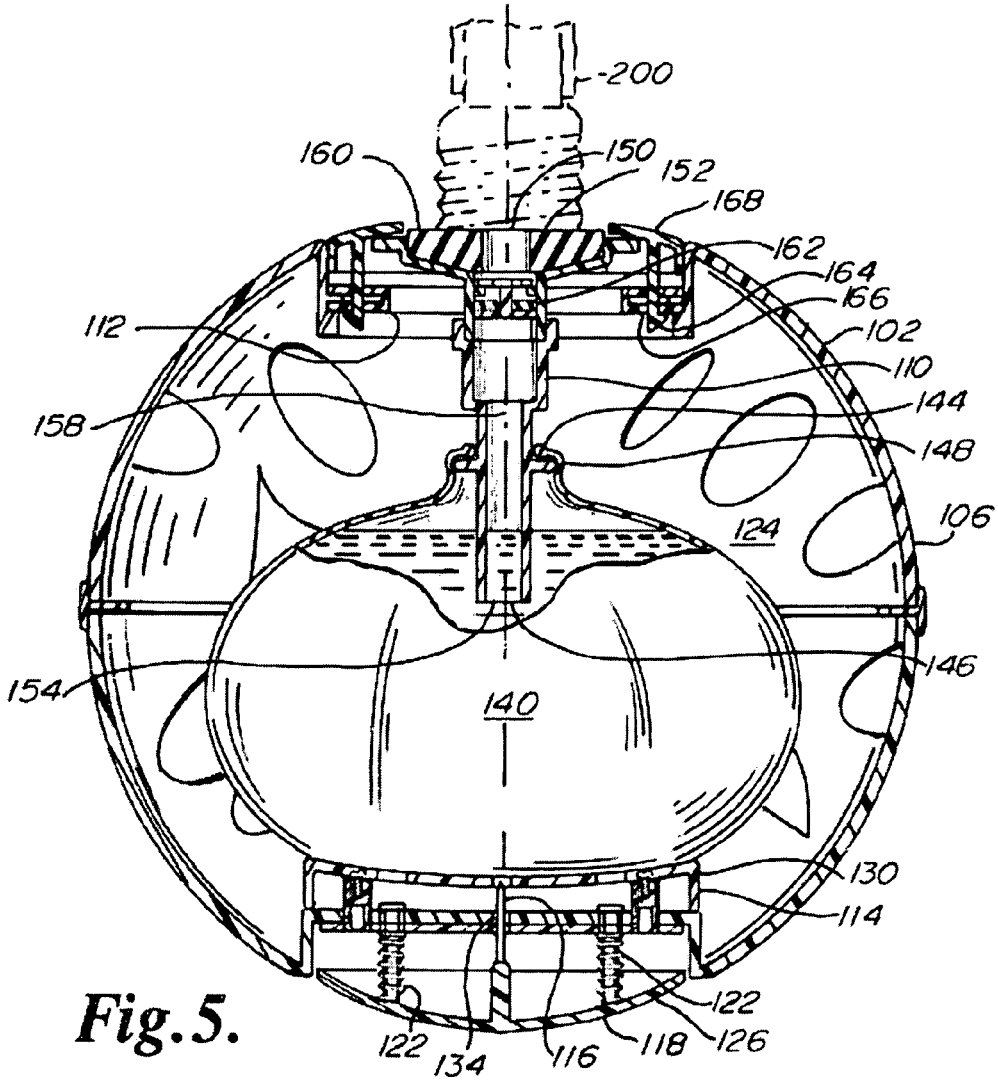
FIG. 5 is a cross-sectional view of the filling of the balloon of the ball of FIG. 1 at a spigot.

To fill balloon 140 with water, housing 106 is simply pressed up against a water supply fitting, such as spigot 200 of FIG. 5, with annular seal 160 engaging the face of the supply fitting, as shown in FIG. 5, and the spigot is turned on. The configuration of seal 160 allows for engagement with a variety of water supply fitting, such as the outlet terminus of a garden hose or the outlet of a kitchen faucet. Water from the turned-on supply flows into inlet 150, through valve 162 and conduit 158, and into the balloon 140 through outlet 154, to inflate and fill the balloon. Viewing through holes 108 of housing 106, one can readily recognize when the balloon is fully expanded to fill hollow interior chamber 124, at which time either spigot 200 may be turned off or the housing 106 may simply be removed from the spigot to avoid overfilling and bursting the balloon by the pressure of the water supply. Because all interior surfaces of interior chamber 124 are smooth and tip 128 of prick 116 is not exposed, there is significant tolerance to overfilling of the balloon without its inadvertent premature bursting.

It is found through experimentation that filling may be optimized for certain balloons according to the length of post 142 and the position of the post's inner end 146 within chamber 124. As some balloons are prone to expand during filling from their base to their tip, tube 142 is most suitable for filling the widest variety of balloons when its length is such that inner end 146 lies at approximately the center of interior chamber 124.

In play, water-filled ball 100 is thrown back and forth amongst participants in various versions of the game of "catch", as shown in FIG. 1. As a catching participant 202 catches ball 100, he must be careful to try to catch it without touching activator button 118. If activator button 118 is not touched, there is no chance for balloon 140 to burst and for participant 202 to be splashed. If, however, activator button 118 is touched during catching, it is likely that it will be moved inwardly and force prick 116 to extend through hole 134 of sub-housing 130 and into hollow interior chamber 124, and will puncture balloon 140 and cause it to burst, thereby soaking the catching participant 202.

In addition to the ornamental advantages of the design and disposition of holes 108, because the holes are disposed in an evenly dispersed array about the ball, as seen in the figures, and because the holes have various sizes and shapes, it is found that the spray distribution from the toy during bursting is optimized, thereby maximizing the soaking of victim participants.

In variations of the games playable with ball 100, victim participants who are soaked during catching may receive demerit points or be disqualified. In a first game, combatant participants may throw the ball back and forth "at" each other in the hopes that the balloon will burst and the competing participant will be disqualified. In a second game, teammate combatants may carefully throw the ball back and forth "to" each other in the hopes that the balloon will not burst, with merit points collected for each such successful exchange.

With practice, throwing participants may learn to throw the ball with more or less spinning motion to catching participants to make it harder or easier, respectively, for the catching participants to focus on the actuator button 118 during catching and to avoid touching it and getting soaked. For instance, if the two participants were on the same team, as in the second game described above, and competing against other team pairs, and the object of the game was to see which team could throw the ball back and forth the highest number of times without bursting the balloon, throwing participants would benefit from causing less spinning motion as the ball is thrown to make it easier for the catching teammates to see and avoid the actuator button during catching. While if the object of another game, such as the first game described above, was to eliminate competing participants by throwing the ball at them and trying to soak them, throwing participants would benefit from causing more spinning motion as they throw the ball to make it harder for their catching competitor to see and avoid the actuator button during catching.

Since the bursting of balloon 140 is entirely under the control of the participants, the participants may develop skill with practice, and players of equivalent skill levels may compete against each other knowing that their success will not be purely a matter of chance.

It will be appreciated by those skilled in the applicable arts that the foregoing teaches merely one of an infinite number of possible embodiments of the invention, and that the disclosure thereof is not meant to and should not limit the rights to which the inventor is entitled in any way, which rights should only be limited by the following claims.

I claim:

1. A throwing and catching toy comprising:

a housing having a perforated outer shell surrounding a hollow interior chamber;

an actuator adjacent said outer shell;

a liquid-fillable balloon disposed within said chamber;

a prick communicating with said actuator and immediately extendable into said chamber upon actuation thereof;

a fluid inlet adjacent said outer shell;

a fluid outlet in fluid communication with said balloon;

a fluid conduit communicating between said inlet and said outlet for receiving liquid from a supply and liquid-filling said balloon therewith;

wherein actuation of said actuator causes said prick to extend into said chamber to burst said liquid-filled balloon, where-upon said liquid there-in flows from said chamber through said perforated outer shell and out of said housing;

wherein said conduit comprises an intake valve allowing liquid flow from said inlet to said outlet and denying liquid flow from said outlet to said inlet;

wherein a fitting comprises said inlet, said outlet, and said conduit; and said fitting is removably insertable with said balloon through an orifice in said outer shell and into said interior chamber;

wherein said outlet of said fitting is adapted to receive said balloon thereon and to enable the replacement of said balloon when said fitting is removed; and wherein said housing comprises a longitudinal axis, and said inlet, said outlet, said balloon, said prick, and said actuator are coaxially aligned thereon.

2. The toy of claim 1 wherein said housing is spherical and said longitudinal axis comprises a centerline thereof.

3. The toy of claim 2 wherein said actuation of said actuator comprises an inwardly directed translation along said longitudinal axis causing said prick to extend into said chamber along said longitudinal axis to burst said liquid-filled balloon.

4. The toy of claim 3 wherein said perforated outer shell comprises a plurality of holes there-through and substantially evenly distributed there-about.

5. The toy of claim 4 wherein said plurality of holes comprises a plurality of hole sizes and a plurality of hole shapes.

6. A throwing and catching toy comprising:

a housing having a perforated outer shell surrounding a hollow interior chamber;

an actuator adjacent said outer shell;

a liquid-fillable balloon disposed within said chamber;

a prick communicating with said actuator and immediately extendable into said chamber upon actuation thereof;

a fluid inlet adjacent said outer shell;

a fluid outlet in fluid communication with said balloon;

a fluid conduit communicating between said inlet and said outlet for receiving liquid from a supply and liquid-filling said balloon therewith;

wherein actuation of said actuator causes said prick to extend into said chamber to burst said liquid-filled balloon, where-upon said liquid there-in flows from said chamber through said perforated outer shell and out of said housing; and wherein said housing comprises a longitudinal axis, and said inlet, said outlet, said balloon, said prick, and said actuator are coaxially aligned thereon.

7. The Toy of claim 6 wherein said housing is spherical and said longitudinal axis comprises a centerline thereof.

8. The toy of claim 7 wherein said actuation of said actuator comprises an inwardly directed translation along said longitudinal axis and causes said prick to extend into said chamber to burst said liquid-filled balloon along said longitudinal axis.

9. The toy of claim 8 wherein said perforated outer shell comprises a plurality of holes there-through and substantially evenly distributed there-about.

10. The toy of claim 9 wherein said plurality of holes comprises a plurality of hole sizes and a plurality of hole shapes.

11. The toy of claim 10 wherein said actuator comprises an actuation surface co-spherical with said housing.

12. The toy of claim 11 wherein said inlet comprises an annular seal disposed there-around and adapted to engage a water-supply outlet such that when said housing engages said water supply at said seal and water to flows from said water supply, substantially all of said water flows through said inlet and into said balloon.

13. A throwing and catching toy comprising:

a spherical housing having a longitudinal axis along a centerline thereof, said housing comprising a perforated outer shell surrounding a hollow interior chamber;

said perforated outer shell comprising a plurality of holes of a plurality of shapes and a plurality of sizes there-through and substantially evenly distributed about said outer shell;

a liquid-fillable balloon disposed within said chamber;

a balloon bursting mechanism aligned on said longitudinal axis and comprising:

an actuator adjacent said outer shell comprising an actuation surface co-spherical with said housing and adapted for actuation along said longitudinal axis; and a prick communicating with said actuator and immediately extendable along said longitudinal axis and into said chamber upon actuation of said actuator;

a fitting aligned on said longitudinal axis transversely disposed from said bursting mechanism and comprising:

a fluid inlet disposed substantially co-spherically with said housing and comprising an annular seal to engage a water-supply outlet;

a fluid outlet disposed within said chamber in fluid communication with said balloon and adapted to receive said balloon thereon;

a fluid conduit communicating between said inlet and said outlet for receiving liquid from a supply and liquid-filling said balloon therewith; said conduit comprising an intake valve allowing liquid flow from said inlet to said outlet and denying liquid flow from said outlet to said inlet;

said fitting removable from said housing and re-insertable with said balloon through an orifice in said outer shell and into said interior chamber to enable the replacement of said balloon;

wherein actuation of said actuator causes said prick to extend into said chamber to burst said liquid-filled balloon, where-upon said liquid there-in flows from said chamber through said plurality of holes and out of said housing.

14. A game using the toy of claim 13 comprising;

removing said fitting from said housing and affixing said liquid-fillable balloon in a deflated state on the outlet thereof;

re-inserting said fitting and said deflated balloon through said orifice and affixing said fitting to said housing;

engaging said housing to a water supply at said seal and water-filling said balloon within said chamber;

throwing said water-filled toy to a catching participant with the catching participant's objective of avoiding actuating said actuator during catching and thereby causing said balloon to burst.

15. The game of claim 14 wherein catching participants that cause said balloon to burst are disqualified.

* * * * *